US005256838A

United States Patent [19]

Benda

[11] Patent Number: 5,256,838

[45] Date of Patent: Oct. 26, 1993

[54] LOCK OUT FOR CIRCUIT BREAKERS HAVING HOLE IN ACTUATING LEVER

[76] Inventor: Steven J. Benda, P.O. Box 782, Cokato, Minn. 55321

[21] Appl. No.: 907,811

[22] Filed: Jul. 2, 1992

[51] Int. Cl.[5] ..... H01H 9/28

[52] U.S. Cl. ..... 200/43.15

[58] Field of Search ..... 200/43.14, 43.15, 43.11, 200/43.19, 43.21, 43.16

[56] References Cited

U.S. PATENT DOCUMENTS 2,937,248 5/1960 Michetti ..... 200/43.21

4,897,515 1/1990 Zubar et al. ..... 200/43.14

*Primary Examiner*—Renee S. Luebke

*Attorney, Agent, or Firm*—Paul H. Gallagher

[57] ABSTRACT

A slide element has legs springable toward and from each other, the legs having pins on their mutually opposed inner surfaces insertable into a hole in the switch actuating lever. The slide element extends longitudinally of the lever, and therebeyond. A blocking element fits over the slide element, and locks it in place, on the lever, and holds it immovably within the blocking element. The blocking element reacts with elements of the switch to hold itself in place, and thus hold the switch lever in position. One form of the device includes a locking lever for mechanically forcing the blocking element down against the switch into blocking position.

19 Claims, 4 Drawing Sheets

LOCK OUT FOR CIRCUIT BREAKERS HAVING HOLE IN ACTUATING LEVER

CROSS REFERENCE

My prior application Ser. No. 07/644,554, filed Jan. 23, 1991, now U.S. Pat. No. 5,122,624, dated Jun. 16, 1992.

PRIOR ART

U.S. Pat. No. 4,882,456, issued Nov. 21, 1989 to Hovanic.

BRIEF SUMMARY OF THE INVENTION

The invention resides in the field of controlling circuit breakers in an electrical system, and more specifically, to block out a circuit breaker in open position. The invention is directed particularly to those situations where the circuit breakers are to be locked out individually, perhaps a small number of them, or a large number of them.

Such circuit breakers, also known as switches, have actuating levers or tongues for actuating the switches. Certain of the tongues have holes therethrough while others do not have such holes.

A principal object of the invention is to provide a lock out particularly designed for use with circuit breakers having holes in the actuating levers. Another object is to provide such a lock out that is positive in action.

Still another object is to provide such a lock out that is extremely simple in design and construction, being made up entirely of molded parts.

Another object is to provide such a lock out that can be applied to the circuit breaker directly from above, i.e., in direction toward the face of the circuit breaker from which the actuating lever extends.

Another object is to provide such a lock out wherein a single size lock out can be used on circuit breakers or switches of different sizes.

Still another object is to provide such a lock out wherein, when it is applied to a switch, it can be readily determined visually how it is so applied, i.e., whether the switch lever is OFF or ON.

BRIEF DESCRIPTION OF THE SEVERAL VIEWS OF THE DRAWINGS

FIG. 6 is a side view, oriented according to FIG. 3 of a slide element.

FIG. 7 is a view taken from the right of FIG. 6.

FIG. 8 is a side view taken of the blocking element.

FIG. 9 is a sectional view taken at line 9—9 of FIG. 8.

FIG. 10 is a view from the left of FIG. 8.

FIG. 11 is a top view of FIG. 8.

FIG. 12 is a side view of a keeper pin.

FIG. 13 is a view of the blocking element of FIG. 10 with the side element of FIG. 7 in position therein.

FIG. 14 is a view from the right of FIG. 13, with the slide element in raised position.

FIG. 15 is a side view of a slide element.

FIG. 16 is a view from the left of FIG. 15.

FIG. 17 is a side view of the blocking element.

FIG. 18 is a top view of the blocking element of FIG. 17.

FIG. 19 is an end view from the right of FIG. 18.

FIG. 20 is a top view of a locking lever.

FIG. 21 is a side view, from the bottom of FIG. 20.

FIG. 22 is a side view incorporating the parts of FIGS. 15–21 showing the locking lever in an initial position, not yet locked.

FIG. 23 is a view showing the parts of FIG. 22 with the locking lever in locked position.

DETAILED DESCRIPTION

Figure 3:
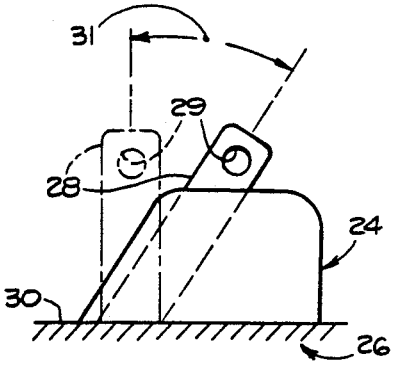
FIG. 3 is a view from the right of FIG. 2.
Figure 2:
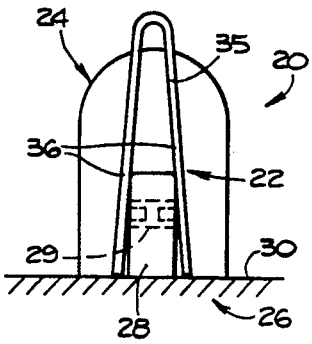
FIG. 2 is a view similar to FIG. 1 but showing the lock out applied to the switch.
Figure 1:
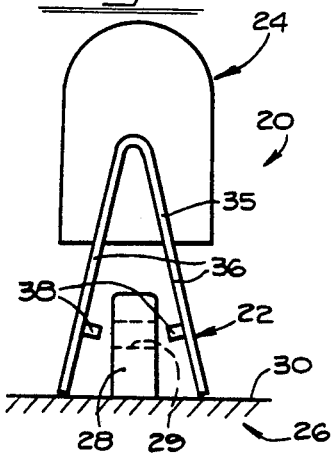
FIG. 1 is a diagrammatic view of a lock out made according to the present invention in a position representing an initial step in applying it to a switch.
Figure 4:
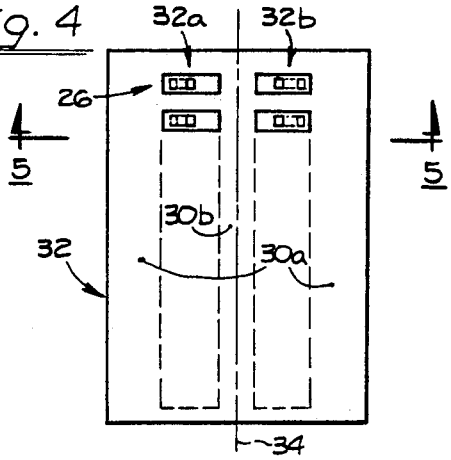
FIG. 4 is a semi-diagrammatic view of the front face of a panel including a plurality of switches.

Referring in detail to the drawings, and particularly to FIGS. 1–3, the device is indicated as a whole at 20 and includes two main parts, a locking slide element 22 and a blocking element 24. As noted above, FIGS. 1–3 are semi-diagrammatic, i.e., they show the main parts and indicate their function in the use of the lock out. The locking slide element 22 is shown in association with a circuit breaker or switch 26 of standard kind, having an actuating lever or tongue 28 with a hole 29, extending to the exterior of the switch through the front face or top face 30 of the circuit breaker. Circuit breakers are often referred to as circuit breaker switches and sometimes as simply switches, and for convenience, they will be referred to herein at times as switches. The switch lever 28 is movable between an OFF position shown in full lines and an ON position shown in dot-dash lines. It will be noted that the switch lever in OFF position is at an angle 31 to the vertical, a feature that is of significance in the functioning of the lock out. The switch lever, when in ON position is often vertically disposed, or perpendicular to the switch face 30. Such switches are often mounted in a bank as shown in FIG. 4 where the switches may be mounted on a panel 32 in two columns, **32*a*, 32*b*, relatively close together, and so disposed that the switch levers in the two columns are disposed mutually oppositely, and when in OFF position are inclined at an angle away from the center. This feature is also of significance and will be referred to again hereinbelow. Generally the position of the switches is such that the outer portion 30*a* of the face is broader, than that portion 30*b*** inwardly thereof.

For convenience, the lock out will be described as oriented in FIGS. 1–3, i.e., the switch 26 faces upwardly, and the actuating lever 28 extends generally upwardly, but the lever and the lock out can be disposed in any of various positions, and the description is to be interpreted accordingly.

A feature of the invention is related to how a plurality of switches are arranged in a panel, this being a common step in laying out the switches. FIG. 4 shows such a panel as referred to above, the columns of switches being positioned on opposite sides of a center line 34. The actuating lever or tongue 28 (FIG. 5) in the ON position is upright or perpendicular to the face of the panel, and in the OFF position at an acute angle thereto. Also, when in the ON position, it is adjacent to the middle or center line, and in the OFF position it is directed toward the outer side edges of the panel. The lock out is applied to the switch when the switch is in OFF position and because of the usual small space 30*b*, the larger space 30*a* more readily accommodates the lock out. This feature will be referred to again hereinbelow in the detail description of the individual embodiments of the invention.

As a general statement of the overall operation of the device, the slide element 22 includes a main body or shank 35 and legs 36 extending downwardly therefrom. The legs 36 have inwardly facing pins 38. The legs 36 are manually positioned on opposite sides of the actuating lever 28, and then sprung inwardly or toward each other and the pins 38 enter into the hole 29 in the switch lever, in accordance with the adaptability of the lock out to the switch.

Reference is now made to FIGS. 6–14 showing one form of lock out including the general features of FIGS. 1–3 and specific details and features of construction.

In this form of the device the locking slide element is indicated at 42, and includes an upper or main body or shank 44, and a pair of legs 54. This locking slide element is a one piece integral member of molded plastic. The body or shank 44 includes a pair of keeper fingers 46 biased outwardly as shown in full lines in FIG. 6, and springable to inner positions 46*a* in notches 48. Below the fingers 46, the body has a wide extension 50 with a transverse locking hole 52 therethrough.

The locking legs 54 extend downwardly from the shank 44, at the top extending straight from the shank, at 56, below which they diverge at 58, and again straighten at the bottom forming shoulders 59.

The legs 54 are provided with pins 60 directed toward each other, and arranged for entering into the hole 29 in the switch lever as referred to again hereinbelow.

The blocking element of the present form of the device, and constituting the member identified diagrammatically at 24 in FIGS. 1–3, is shown in detail construction in FIGS. 8–11. The blocking element in this form is indicated at 60 and is generally in the form of a shell, having a cruciform opening or passage 62 extending vertically therethrough. This passage 62 is shown in cross section in FIG. 9, and includes relatively deep channels 64 oppositely arranged in one direction, and relatively shallow channels 66 oppositely arranged transversely thereto.

The blocking element 60 has a lower surface 67 at an acute angle to the general longitudinal direction indicated by the center line 68. This surface 67 will bear on the face of the switch as referred to again hereinbelow, the angular relationship having to do with the angular position of the actuating lever of the switch.

The deep channels 64 terminate upwardly at inclined surfaces 69 (FIG. 10) which accommodate the shoulders 59 (FIG. 7) of the legs 54.

Figure 10:
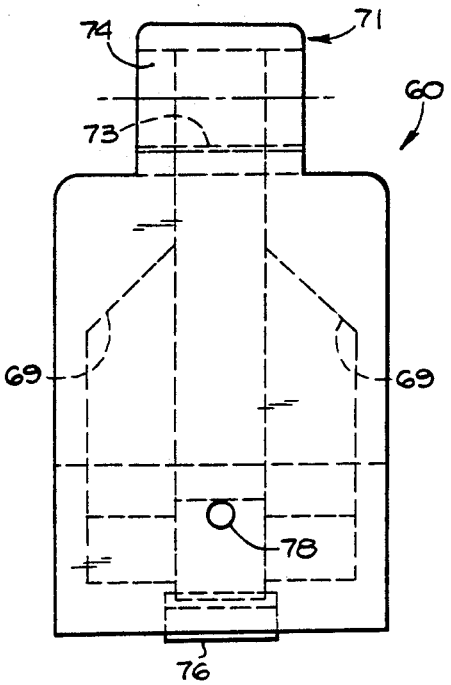
Figure 8:
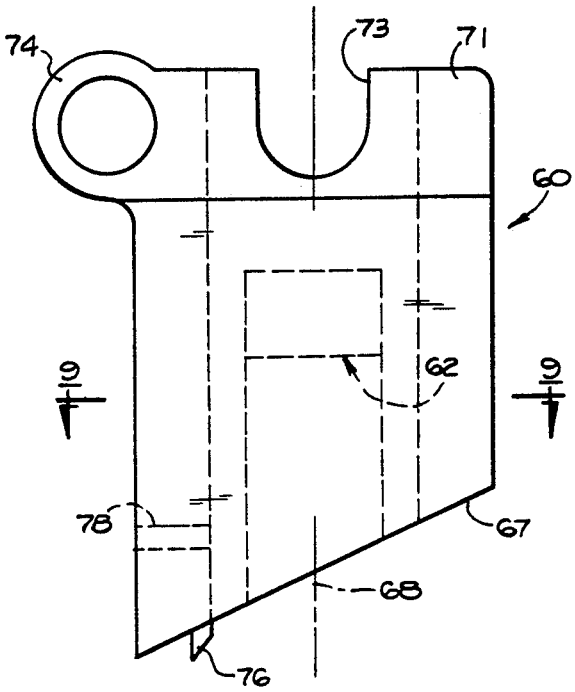
Figure 11:
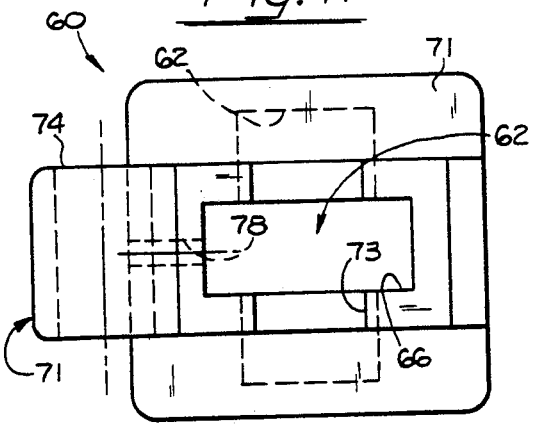
Figure 9:
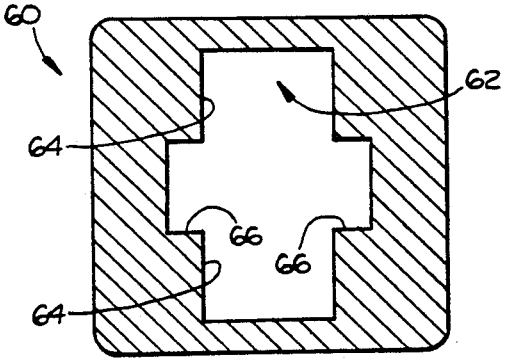
Figure 12:
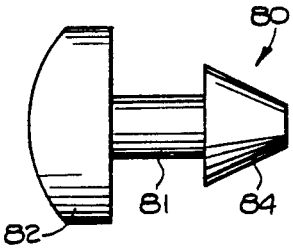

The shallow channels 66 extend through the top of the blocking element (FIGS. 9, 11). The top portion of the blocking element indicated at 71, extends the full width of the blocking element in one direction (FIG. 8) but is relatively narrow as viewed in the opposite directions (FIGS. 10, 11). This portion 71 is provided with a transverse notch 73 opening upwardly, and at one side it is provided with a loop 74 forming a convenient means for tying a tag to the device.

The blocking element 60 is provided with an integral toe or lug 76 which enters into an opening in the switch, when the device is applied to the switch, as described below.

The blocking element 60 is provided with an aperture 78 through a wall thereof and a keeper pin or stop pin 80 (FIG. 12) is fitted in this aperture. The pin includes a shank 81, a large head 82, and a projection 84 at a front end. In use, this keeper pin is fitted in the hole 78 for preventing the slide element from accidentally falling out of the blocking element, as referred to again hereinbelow, by being engaged by the surface element 85 (FIG. 7) of the slide element.

Figure 13:
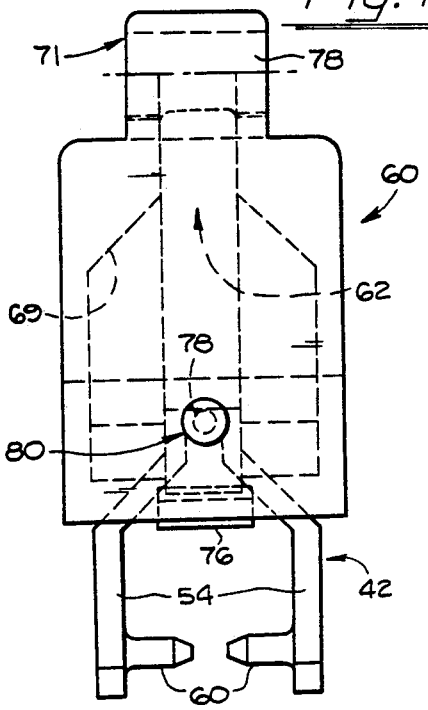
Figure 14:
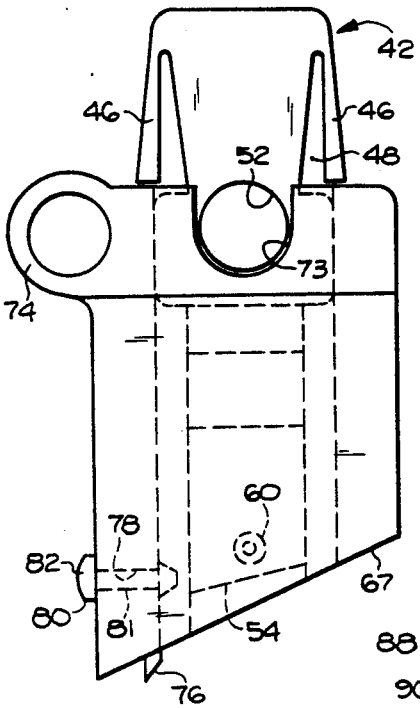

In the assembly and use of the device, the slide element 42 is inserted in the lower end of the blocking element as shown best in FIG. 13. After this initial step, the pin 80 is inserted in the hole 78, as referred to, to the position shown in FIG. 14. In so inserting it, the leading enlargement 84 is compressed or compacted in being forced through the hole, but it re-assumes its normal larger size when in place. This pin serves the purpose of normally preventing the slide element from sliding downwardly out of the blocking element, and thus holding those two elements together, as an effectively single device.

Figure 5:
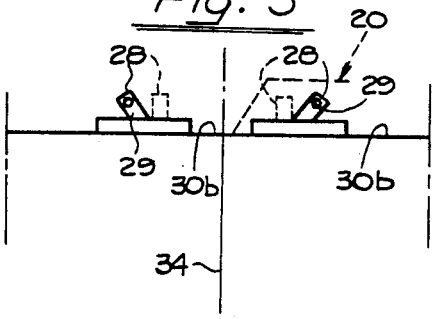
FIG. 5 is a view oriented according to line 5—5 of FIG. 4.
Figure 6:
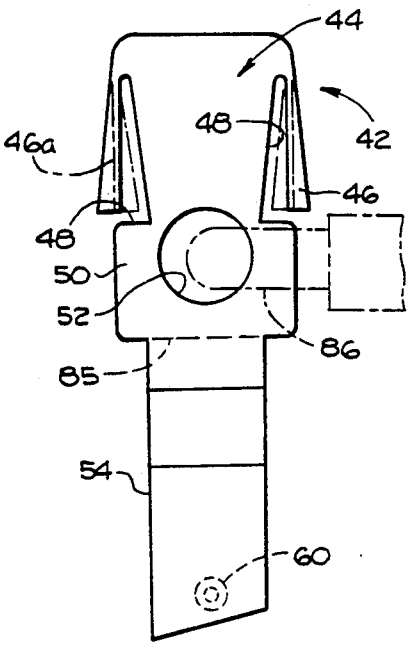
FIGS. 6–14 show one form of lock out, embodying the feature shown in FIGS. 1–3, and showing the details of the device.
Figure 7:
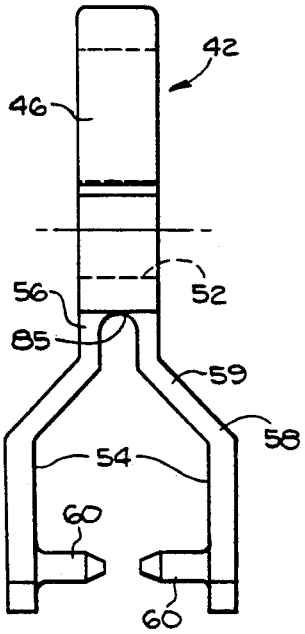

With the slide element so fitted in the blocking element, the device is applied to the switch by fitting it over the switch lever as oriented in FIG. 5. The switch lever, although disposed at an angle, extends generally in an upward direction, and the device is fitted over the actuating lever in direction from the end of the latter, i.e., it is not applied laterally or side ways, but in the direction of the longitudinal axis of the switch lever. As a next step, the device is manipulated for spreading the legs 58 for receiving the switch actuating lever 28 therebetween, and the pins 60 are aligned with the hole in the switch lever and then the legs released, and the pins enter into the hole. Then, the blocking element is pushed down on the switch, sliding relative to the slide element, and the blocking element encases the legs 54 and the bottom surface 67 of the blocking element engages the top surface of the switch. In this act also, the toe 76 (FIG. 14) enters into the hole of the switch through which the actuating lever extends. When it is assembled on the switch, this toe effectively fills the space between the actuating lever and the edge of the switch and constitutes a positive article blocking the swinging movement of the switch lever toward ON positions.

In the movement of sliding the blocking element over the slide element, the upper end of the latter extends through the passage in the blocking element and is exposed at the top (FIG. 14) and in such a position that the keeper fingers 46 snap outwardly and engage the top surface of the blocking element. In this position also the hole 52 (FIG. 6) in the slide element is in register with the slot 73 (FIG. 14), and an element 86 of a lock such as a padlock can be inserted therethrough for positively locking the parts of the device together. While the keeper fingers 46 hold the slide element in locking position, they may be squeezed by the fingers to release it, but the lock 86 positively locks the device in position.

Figure 15:
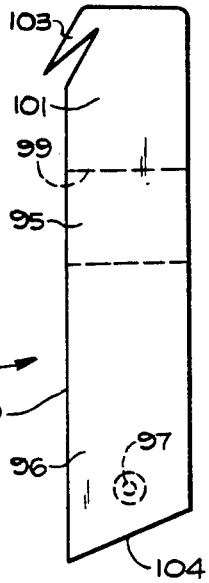
FIGS. 15–23 show another form of lock out embodying the features of FIGS. 1–3, and further details thereof.
Figure 18:
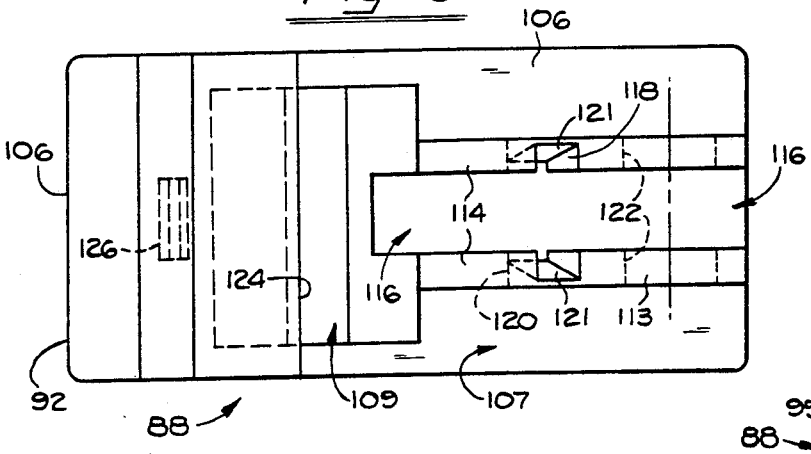
Figure 16:
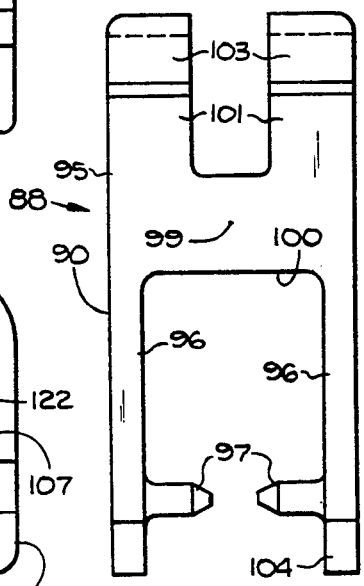
Figure 17:
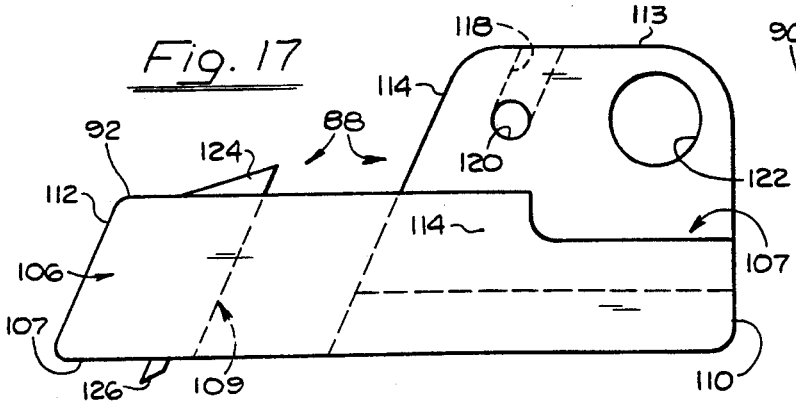
Figure 19:
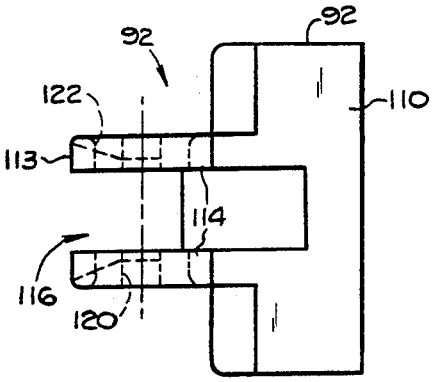
Figure 20:
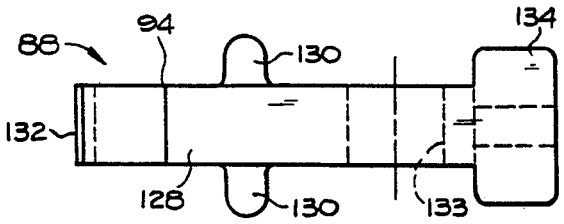
Figure 21:
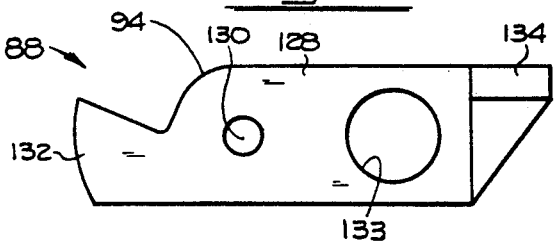
Figure 22:
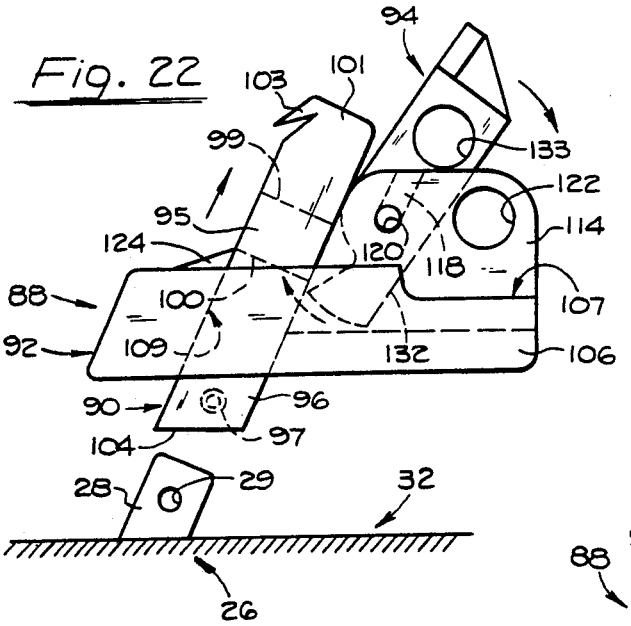
Figure 23:
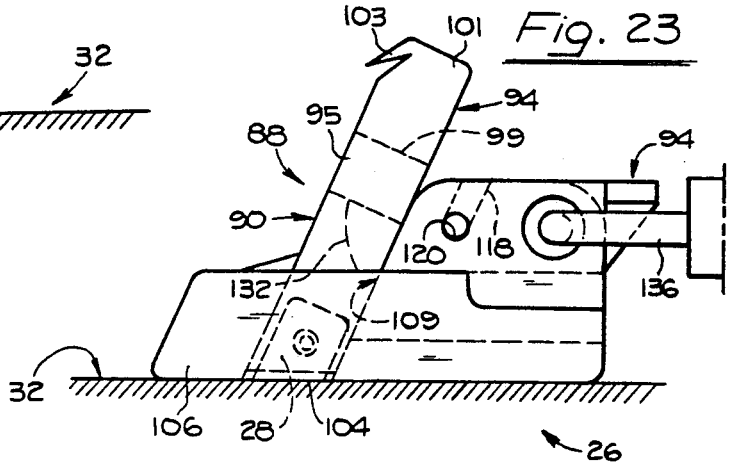

FIGS. 15–23 show another form of lock out of the invention. FIGS. 15, 16 and 20 show the individual parts of the device while FIGS. 22, 23 show the parts assembled in a complete lock out. The complete lock out is identified at 88, shown in FIGS. 22, 23 applied to a switch or circuit breaker 26, referred to above, having a front or top face 32 and the actuating lever 28 extending above the front surface at an acute angle to that surface, in this case to the right, in OFF position.

The lock out 88 of this second form includes three separate parts, a slide element 90 (FIGS. 15, 16), a blocking element 92 (FIGS. 17, 18) and a locking lever 94 (FIGS. 20, 21).

Each of the three main components 90, 92, 94, is a single, one-piece, integral article, preferably of molded plastic.

The slide element 90 includes a body portion 95, a pair of spaced legs 96 having locking pins 97 adjacent to the bottom and directed toward each other. The body portion 95 forms a cross bar 99 having an under surface 100. Extending upwardly from the cross bar 99 are a pair of spaced uprights 101, these uprights having hooks 103 constituting keeper fingers to be referred to again. The slide element is provided with an angled lower end surface 104 which substantially registers with the lower surface of the blocking element in engaging the face of the switch as referred to again hereinbelow.

The blocking element 92 includes a main body portion 106 having an upper surface 107 and an upright passage 109 therethrough. For convenience, this blocking element, and thus the entire lock out when assembled, is referred to as oriented in FIGS. 17–19, having a rear end 110, a front end 112, and a top 113.

The blocking element 92 includes a pair of walls 114 forming a channel 116 therebetween, these walls having grooves or slots 118 facing each other and opening through the top edges of the walls and, progressing downwardly, terminating in apertures 120 extending through the walls. These grooves have floors or bottom surfaces 121 inclined toward each other, converging downwardly. These grooves are for receiving hinge pins referred to hereinbelow. The walls 114 are also provided with locking holes 122 for accommodating a locking element as referred to below.

The blocking element 92 is provided with an upstanding lug 124 preferably having an inclined upper surface, which is engaged by the keeper finger 103 (FIG. 15) of the slide element, for normally retaining the slide element in the blocking element to prevent its accidentally dropping out.

Additionally, the blocking element is provided with a toe or lug 126 which enters into the hole in the switch through which the actuating lever extends, for providing an additional locking effect. It will be noted that the channel 116 extends forwardly into the upright passage 109.

The component 94 (FIGS. 20, 21) identified above, may be referred to as a locking lever, and it includes a main bar 128 having pivot pins 130 extending therefrom on opposite sides. At the forward end is an extension 132 forming a hook or pry element, and the lever is provided with a locking hole 133 at its rearward end for cooperating with the hole 122 (FIG. 17) for receiving a lock element. The lever 128 may also include a transverse handle element 134.

In the assembly and use of the device of this form (FIGS. 15–23), the locking slide element 90 is inserted upwardly through the passage 109 in the blocking element, to a position in which the keeper finger 103 moves above the lug 124. In this step the keeper finger may flex inwardly, to the right, FIG. 22, to pass by the lug 124, and thereafter it flexes outwardly and engages the lug upon downward movement of the slide element, and keeps the latter from falling out of the passage. In this position of the lock out as shown in FIG. 22, the lower end of the slide element extends downwardly below the locking element.

The locking lever 94 is put in place in the blocking element (FIG. 22) by positioning it upright as in this figure and then fitting the pivot pins 130 in the grooves 121 and forcing it downwardly until the pivot pins snap into the holes 120, the walls 114 spreading slightly (FIG. 18) to accommodate this movement. The locking lever in this figure, is in inoperative position, and to move it to locking position, it is swung clockwise and the hook element 132 is thereby swung under the cross bar 99 (FIG. 22) of the slide element, it being understood that when the slide element is in such position, the cross bar 99 is positioned for enabling the hook 132 to be moved thereunder.

With the parts thus assembled and with the locking lever still in inoperative position, the lock out is applied to the switch as shown in FIG. 22, and in this position the slide element is directed longitudinally of the switch actuating lever 28. The lock out is then moved downwardly, and the legs 96 are manually spread to enable the pins 97 to pass over the actuating lever 28, and they are then released and the pins enter into the hole 29 in the actuating lever. Thereafter the blocking element is moved downwardly on the slide element, and the walls of the passage 109 in the blocking element confine the legs 96 and hold them in an inward position in locking engagement on the actuating lever 28.

This is followed by swinging the locking lever 94 clockwise, i.e., its right hand end downwardly, as referred to above and this pries upwardly on the slide element by means of the hook 132, resulting in a locking position. When the locking lever 94 is thus moved down to its lower position (FIG. 23) the hole 133 registers with the hole 122 and an element 136 of a lock is inserted in the aligned holes.

This action of the locking lever 94 pushes the blocking element downwardly tightly against the switch and effects a secure and firm locked position.

In this placement of the lock out on the switch, the toe 126 (FIG. 17) on the blocking element, as indicated above, in being inserted in the hole through which the actuating lever extends, performs an additional locking effect in that as the locking lever 94 is swung downwardly, the action produces a forward motion on the blocking element, i.e., to the left FIG. 22, but the toe 126 being in the opening referred to, reacts against this action and aids in producing a firm locking arrangement.

In this form of the lock out (FIGS. 15–23) the passage 109 is so positioned that the blocking element has a larger portion to the right thereof than to the left. By reason of this arrangement, when the lock out is applied to the switch in OFF position, as shown in FIG. 5 in the right hand portion thereof, the larger portion of the blocking element extends to the right of the switch, or in the wide area 30*a*. This large portion of the under surface of the blocking element engages that surface throughout its own length, and thus provides a great bearing area for producing a firm locking effect. This feature will help to insure that the user locks a switch in the OFF position only since inadvertently locking a switch ON may have detrimental consequences. Thus the wider portion of the lock out engaging the wider portion of the face portion 30*a* provides a firm locking arrangement in accommodating the usual arrangement of switches in a panel of FIGS. 4, 5.

Additional features and advantages of this invention over the invention of my copending application identified above include, a) installation is accomplished by applying the device from above the switch in direction longitudinally of the switch lever; the required space for product usage is substantially that of the blocking element because the locking elements are effectively internal to the blocking element;

b) the tongue on the bottom surface of the blocking element assists in blocking the switch lever from swinging;

c) the slide element is adaptable to being made of selected different widths, by placing an insert in the mold;

d) visual confirmation of the ON/OFF position can be quickly made, because the entire device is in a readily noticeable position corresponding to the position of the switch lever;

e) the blocking element, in the form of FIGS. 15-23, can be mechanically forced into position, against and onto the switch face plate.

I claim:

1. A lock out adapted for use on a switch having a front surface, and an actuating lever extending through the front surface to the exterior of the switch, and movable between opposite ON and OFF positions angularly space apart, and in at least the OFF position being disposed at an acute angle to the front surface, and the actuating lever having holes therein on opposite sides, at said exterior, comprising, said lock out having a longitudinal direction and having a front end and a rear end, a slide element having an upper body portion, and a pair of downwardly extending legs movable toward and from each other, the legs having pins extending toward each other, a blocking element having a vertical passage therethrough, the slide element being mounted in the vertical passage, and the two elements being relatively slidable between an upper retracted position and a lower active position of the slide element, the lower ends of the legs, when in the retracted position, being capable of being spread apart and positioned on opposite sides of the actuating lever and, then released for inserting the pins in the holes in the actuating lever, the blocking element, in the active position of the slide element, being operable for confining the arms against spreading, the blocking element, when the elements are in the active position, having interaction between the actuating lever and the front surface of the switch and thereby operable for preventing the switch lever form being moved out of its OFF position.

2. A lock out according to claim 1 wherein, the actuating lever has a longitudinal dimension extending from said front surface, and wherein, said vertical passage is so positioned that in response to applying the lock out to the switch, it is so applied in direction along said longitudinal dimension of the actuating lever.

3. A lock out according to claim 1 wherein, the blocking element has downwardly directed wall elements in said passage, and the slide element has upwardly directed elements that engage said downwardly directed wall elements and prevent upward movement of the slide element out of the passage.

4. A lock out according to claim 1 wherein, the slide element has an enlargement forming a downwardly directed stop element, the blocking element has an aperture adjacent the lower end of said passage into said passage, and the lock out includes a headed keeper pin separate and apart from the blocking element fitted in said aperture and normally held therein and extending into said passage and positioned for engagement by said stop element and thereby operable for normally retaining the slide element against movement downwardly out of said passage.

5. A lock out according to claim 1 wherein, the blocking element includes a toe extending downwardly from its under surface adjacent said passage, positioned, when the lock out is applied to the switch, for entering into a hole in the switch through which the actuating lever extends to the exterior.

6. A lock out according to claim 1 wherein, the blocking element has an under surface engageable with the front surface of the switch when applied to the switch, said passage being so positioned that when the switch lever is in the passage, the under surface of the blocking element engages the front surface substantially throughout said under surface.

7. A lock out according to claim 6 wherein, the slide element has a lower end surface which, when the slide element is in said passage, is effectively positioned in the same surface containing the lower surface of the blocking element when the slide element and blocking element are in active position, whereby to provide that a portion of the slide element encompasses the switch actuating lever.

8. A lock out according to claim 1 wherein, the slide element and the blocking element have interacting keeper elements normally retaining the slide element in the blocking element against dropping out of said passage.

9. A lock out according to claim 8 wherein, at least certain of the keeper elements are yieldable to enable manual actuation thereof to release the members from each other.

10. A lock out according to claim 8 wherein, in said active position of the elements, the slide element extends above the blocking element, and the keeper elements on the slide element are positioned above the blocking element and releasably engage the blocking element for retaining the slide element against movement downwardly out of said passage.

11. A lock out according to claim 10 wherein, the slide element has a locking hole therethrough, and the blocking element has a locking notch in its upper end, the locking hole and the locking notch being in register when the slide element and the blocking element are in said active position, whereby to enable an extraneous lock to be placed in the locking hole and locking notch, thereby preventing the slide element from dropping out of said passage.

12. A lock out according to claim 1 and including, a locking lever swingable between an inactive position and a locking position, and operable in response to movement to locking position for forcing the sliding element to active position.

13. A lock out according to claim 12 wherein, the locking lever is separate from and detachably mounted in the blocking element.

14. A lock out according to claim 12 wherein, each of the slide element the blocking element, and the locking lever, is a single, one piece, integral molded article.

15. A lock out according to claim 12 wherein, the slide element includes a pair of legs which, when the slide element is in active position, are spaced apart transversely, and includes a transverse bar, and the locking lever engages the transverse bar and acts therethrough in leveraging the slide element to active position. position, whereby to enable an extraneous lock to be placed in the locking hole and locking notch, thereby preventing the slide element from dropping out of said passage.

16. A lock out according to claim 12 wherein, the blocking element has an upright passage in a front portion in which the slide element is mounted, the blocking element has a rear portion which has a pair of transversely spaced walls having top surfaces and forming a channel therebetween, the channel opening into said upright passage, said walls have aligned pivot holes therein and grooves having surfaces leading through the top surfaces of the walls and to and into said pivot holes, and the locking lever has outwardly directed pivot pins, and the locking lever is placeable in the blocking element by inserting a forward end thereof into said channel with the pivot pins riding in said grooves, and in response to continued such movement of the locking lever, the pivot pins ride through the grooves and snap into said pivot holes, the walls having limited yieldability apart such as to enable them to spring outwardly in response to action of the pivot pins riding on said surfaces.

17. A lock out according to claim 12 wherein, the blocking element and the locking lever have locking holes that are aligned when the slide element is in active position and the locking lever is in locking position, enabling reception therein of an extraneous locking means.

18. A lock out according to claim 12 wherein, the slide element includes a keeper hook adjacent an upper end thereof which is positioned above the blocking element when the slide element is in active position, and the keeper hook is compressed in response to movement of the slide element moving upwardly in said passage, and it moves to an outer position when above the blocking element and engages the latter, thereby retaining the slide element against movement downwardly out of the passage.

19. A lockout according to claim 12 wherein, the blocking element has a lower surface and includes a toe extending downwardly from its lower surface adjacent said passage, positioned and operable, when the lock out is applied to the switch, for entering into a hole in the switch through which the actuating lever extends.

* * * * *